US006342125B1

(12) United States Patent
Nordström

(10) Patent No.: US 6,342,125 B1
(45) Date of Patent: Jan. 29, 2002

(54) MULTI-PLY WEB FORMING METHOD AND APPARATUS AND A MULTI-PLY PAPER OR BOARD PRODUCT FORMED HEREBY

(76) Inventor: Bengt Nordström, ÖLønggatan 5a, 852 36 Sundsvall (SE)

( * ) Notice: Subject to any disclaimer, the term of this patent is extended or adjusted under 35 U.S.C. 154(b) by 0 days.

(21) Appl. No.: 09/485,831

(22) PCT Filed: Aug. 19, 1998

(86) PCT No.: PCT/SE98/01490

§ 371 Date: Apr. 13, 2000

§ 102(e) Date: Apr. 13, 2000

(87) PCT Pub. No.: WO99/09249

PCT Pub. Date: Feb. 25, 1999

(30) Foreign Application Priority Data

Aug. 19, 1997 (SE) ..... 9702978

(51) Int. Cl.[7] ..... D21F 11/00

(52) U.S. Cl. ..... 162/132; 162/300; 162/133; 162/299; 162/352; 162/303; 162/304; 162/306; 162/317; 162/351; 162/123; 162/203; 162/212; 162/213; 162/214

(58) Field of Search ..... 162/132, 300, 162/133, 299, 352, 303, 304, 306, 317, 351, 123, 203, 212, 213, 214

(56) References Cited

U.S. PATENT DOCUMENTS

| | | | | |
|---|---|---|---|---|
| 3,056,719 A | | 10/1962 | Webster | |
| 3,543,834 A | | 12/1970 | Stuebe | |
| 3,625,814 A | | 12/1971 | De Noyer | |
| 3,821,073 A | | 6/1974 | Eriksson | |
| 3,856,618 A | * | 12/1974 | Roell | 162/299 |
| 4,153,504 A | * | 5/1979 | Justus | 162/133 |
| 4,285,764 A | * | 8/1981 | Salvai | 162/132 |
| 4,445,974 A | | 5/1984 | Stenberg | |
| 5,607,555 A | | 3/1997 | Grossmann et al. | |
| 5,635,033 A | | 6/1997 | Grossmann et al. | |
| 5,849,159 A | | 12/1998 | Heinzmann et al. | |

OTHER PUBLICATIONS

Attwood, (1991), "Multi–Ply Forming", Pulp and Paper Manufacture, vol. 7, Paper Machine Operations, TAPPI & CPPA; pp. 250–251.

Nordström and Norman, Nord. Pulp Pap. Res 9(1): 53 (1994); 10(1): 33 (1995); J. Pulp Pap. Sci. 21(7):J223 (1995).

* cited by examiner

*Primary Examiner*—Stanley S. Silverman
*Assistant Examiner*—M. Halpern
(74) *Attorney, Agent, or Firm*—Burns, Doane, Swecker & Mathis, L.L.P.

(57) ABSTRACT

A multi-ply web forming method and apparatus are disclosed for forming a top ply onto a base ply. A fiber suspension jet is by means of a secondary headbox (21; 21', 26) delivered into a twin-wire roll nip created by two tensioned wires (16, 22; 16', 22'; 22, 27) one of which (16; 16', 22) carries the moist base ply. The web forming of the top ply is performed solely by means of roll forming (23, 23', 28) of the kind where the fiber suspension jet is delivered to said twin-wire nip at such a high speed to cause a yielding deflection of the outer of said two tensioned wires, while maintaining substantially constant tension during said deflection of the outer wire by guiding said wire on rotating supports (31*a–c*; 31*a'–c'*; 32*a–c*) at least one of which is resiliently or displaceably mounted to compensate for said deflection, wherein the speed of said fiber suspension yet delivered to said twin-wire nip is at least 300 m/min and the wire tension of the outer as well as the inner wire is at least 4 kN/m.

15 Claims, 3 Drawing Sheets

MULTI-PLY WEB FORMING METHOD AND APPARATUS AND A MULTI-PLY PAPER OR BOARD PRODUCT FORMED HEREBY

This invention concerns a method for high speed forming of multi-ply paper or board, a forming apparatus utilizing the method and a paper or board product formed by the method and/or the apparatus according to the invention.

BACKGROUND OF THE INVENTION

Multi-ply forming enables the cost performance relationship of the product to be optimized by using different furnishes in different plies. For many paper products multi-ply technology makes it possible to increase the content of recycled paper and high yield pulps which are interesting both for cost reducing reasons and for environmental reasons. Existing technology fails however to accomplish the task of high speed forming of multi-ply paper or board with superior mechanical properties as well as favourable ply coverage characteristics.

The need for a forming technology applicable to high production rates is stressed by recent developments in wet pressing technology. Shoe presses giving high press impulses and high pressing efficiency are now being installed in the production of most major paper and board grades.

Good ply coverage characteristics, i.e. good formation and purity of the individual plies, is an obvious requirement in order to fully utilize the potential of a multi-ply product. The need for a forming technology yielding superior mechanical properties is stressed by the growing interest to use raw materials with a relatively low strength potential such as recycled fibres and high yield pulps.

Multi-ply forming technology may be grouped into three main categories:

1. Forming each ply in a separate forming unit before couching the plies together.
2. Simultaneous forming of all plies in one forming unit using a multi-layer headbox.
3. Forming the web plies on top of each other in a sequential mode, i.e. forming the second ply on top of the first ply and the third ply on top of the second ply etc. The present invention belongs to this category.

Separate forming is commonly carried out with a multi-fourdrinier machine. Hybrid forming or twin-wire forming (cf. e.g. DE 44 02 273 C2) may also be applied. The increase in dewatering capacity given by two or more separate forming units may be utilized for increased production rates and/or lowered forming consistency for improved sheet properties. All variants of separate forming have one problem in common, however, viz. the ply bonding which generally limits the Z-direction strength of the multi-ply product. Often starch or some other bonding agent has to be sprayed on the plies before couching them together.

While twin-wire forming would be preferable for speeds above 1000 m/min, avoiding free surface instabilities and providing higher dewatering capacity the problem of ply-bonding then becomes worse. This is because a twin-wire-formed sheet ply has two wire sides with poor ply-bonding ability, in contrast to a fourdrinier ply which has one wire side and one top side with a better ply-bonding ability.

Simultaneous forming of a multi-ply product with a multi-layer headbox may also be employed. Examples of multi-layer headboxes are found in EP 0 681 057 A2 and in GB 2 019 465. With this method, however, the dewatering capacity is limited to that given by a single dewatering unit.

Hence, this principle is not suitable for high speed forming, of moderate to high grammages at low forming consistency. Hitherto, it has moreover proved difficult to accomplish acceptable ply coverage characteristics with simultaneous forming.

Multi-ply forming in a sequential mode has traditionally been applied in the forming of two-ply linerboard using a secondary headbox placed some distance downstream a fourdrinier wire with dewatering of the top ply through the base ply formed upstream of the secondary headbox. The problem of ply-bonding is essentially avoided by depositing a fibre suspension onto the pre-formed web. This means that the Z-direction strength of the multi-ply product is often determined by the Z-direction strength of the individual plies rather than by the ply-bonding. Forming a top ply onto a base ply on a fourdrinier wire involves several disadvantages, however. It suffices to mention the drawback regarding dewatering capacity and the severe grammage variations due to the free surface occurring especially above 1000 m/min.

Dewatering in a twin-wire zone created by the wire carrying the base ply and an additional, web-free wire through which the top ply is essentially dewatered has been applied shortly after the secondary headbox in units relying extensively on vacuum generated dewatering (see e.g. Attwood (1991) "Multi-ply forming", Pulp and Paper manufacture Vol. 7 Paper Machine Operations, TAPPI & CPPA; p.250–251). Dewatering through the previously formed web is thus essentially avoided whereby an improved dewatering efficiency is achieved. Dewatering of the top ply through a web-free wire is moreover advantageous with regard to purity and formation of the top ply, because a separate handling of the white-water of the top ply is possible and because any influence of the base ply structure on the top ply is substantially avoided. The capacity of this kind of units is still limited, however, and they are typically used on multi-ply board machines running slower than 600 m/min.

In U.S. Pat. No. 3,543,834 there is disclosed a multi-ply web former utilizing cylinders or rolls. Successive web plies are formed in a forming area between the foraminous belts wrapping a forming cylinder where one of the belts are used in the preceding forming area. According to U.S. Pat. No. 3,543,834 dewatering is accomplished by "centrifugal force and pressure of the foraminous belt against the web".

There is no indication of conditions involving the impinging headbox jet to deflect the outer wire and penetrate into the twin-wire nip. Rather, it can therefore be inferred that the wire geometry is fixed. This means that the principal forming phase is not accomplished over the roll periphery at an essentially constant dewatering pressure. It is then not possible with this arrangement to achieve favourable mechanical sheet properties, since a substantially constant dewatering pressure is a prerequisite for good mechanical properties. The dewatering capacity is moreover unsatisfactory with this arrangement.

U.S. Pat. No. 3,625,814 discloses a multi-ply web former of a similar kind. Dewatering of the pulp stock is said to take place "as the belts come together on the impervious forming roll", which indicates that the geometry of the outer wire is fixed.

The same applies to the multi-ply web former disclosed in U.S. Pat. No. 3,821,073. The fibre suspension is dewatered "in that the water is forced through the two wires as these run together along a portion of the cylindrical surface of the forming roll".

In DE 44 02 273 A1 there is disclosed a two-ply forming unit utilizing twin-wire roll-blade forming for both the base ply and the top ply formed onto the base ply. Roll-blade forming employs only an initial roll dewatering phase followed by blade dewatering, During roll forming, which was introduced in its basic sense some four decades ago (U.S. Pat. No. 3,056,719) and is well known from the field of high speed production of (single-ply) printing paper, the two wires containing the fibre suspension runs on the periphery of the rotating forming roll. The dewatering pressure is determined by the outer wire tension divided by the instantaneous radius of curvature, and during roll dewatering the pressure rises steeply during an initial phase after which it levels off to a plateau. During blade dewatering the wires are deflected over stationary blades resulting in a pulsating dewatering pressure.

Although the employment of roll-blade dewatering means a significantly better machine speed potential than the previously described methods for forming a top ply onto a base ply, it has still drawbacks, in particular with regard to the mechanical sheet properties. The blade dewatering can have a strong adverse effect on the Z-direction strength of the individual plies, meaning that the Z-direction strength of the multi-ply product remains to be a problem despite that the top ply is formed onto the base ply, Moreover, the blade dewatering tends to deteriorate the mechanical properties in the plane.

SUMMARY OF THE INVENTION

The object of the present invention is to provide a method for forming a top ply onto a base ply utilizing a twin-wire unit, in which the short-comings of existing technology are avoided. This object has according to the invention been achieved by carrying out the web forming of the top ply after said twin-wire roll nip solely by means of roll forming of the kind where the fibre suspension jet is delivered to said twin-wire nip at such a high speed to cause a yielding deflection of the outer of said two tensioned wires, while maintaining substantially constant tension during said deflection of the outer wire by guiding said wire on rotating supports at least one of which is resiliently or displaceably mounted to compensate for said deflection, wherein the speed of said fibre suspension yet delivered to said twin-wire nip is at least 300 m/min and the wire tension of the outer as well as the inner wire is at least 4 kN/m.

With base ply is meant a previously formed ply onto which a further ply, the top ply, is formed. The base ply may consist of more than one ply and by repeated usage of the method according to the invention a multi-ply product with an arbitrary number of plies can be formed.

In multi-ply forming, certain advantages may be achieved by forming one, or a few of the plies according to the invented method, e.g. web plies containing weak pulps (high yield pulps or recycled fibres). The task of high speed forming of a multi-ply web with superior mechanical properties and good ply coverage characteristics is however best accomplished by the employment of roll forming of the above stated kind for all plies, including the primary ply.

The invention also refers to a forming apparatus for performing the method comprising a secondary headbox arranged to deliver a fibre suspension jet into a twin-wire roll nip created by two tensioned wires one of which carries the moist base ply, said apparatus comprises as the sole forming unit for forming of the top ply onto the base ply, a roll forming unit including at least one forming roll of the kind where the fibre suspension jet is delivered to said twin-wire nip at such a high speed to cause a yielding deflection of the outer of said two tensioned wires, said apparatus further comprising means for maintaining a substantially constant tension during said deflection of the outer wire by guiding said wire on rotating supports at least one of which is resiliently or displaceably mounted to compensate for said deflection.

The invention further refers to a multi-ply paper or board product formed by the method and/or apparatus defined above.

Further details and characteristics of the invention are stated in the following description and in the dependant claims.

DESCRIPTION OF EMBODIMENTS

Figure 1:
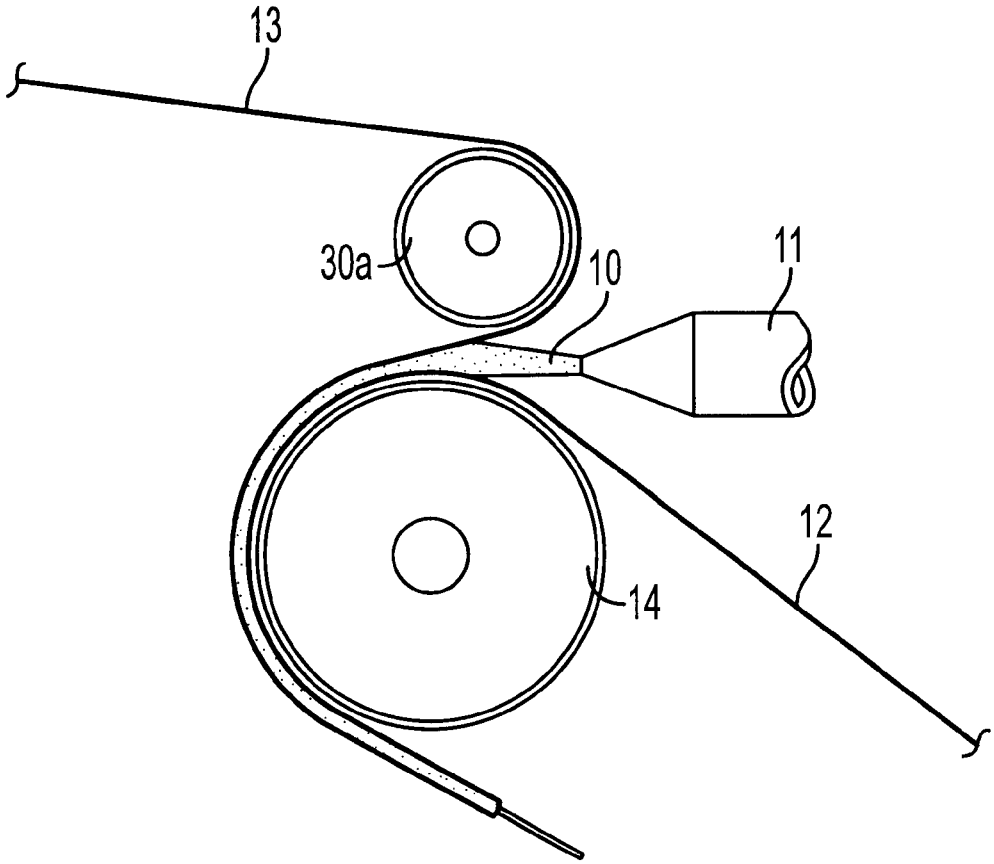
FIG. 1 shows the basic principle for forming a top ply onto a base ply.

The invented method for forming a top ply onto a base ply is schematically shown in FIG. 1. A fibre suspension jet 10 exiting from a headbox 11 enters a nip created by one tensioned forming wire 12 caring a moist web, preferably of 7–15% dryness, and another web-free, tensioned wire 13 both of which wrap around a rotating forming roll 14. The ingoing moist web is preferably carried by an inner wire as shown in the figure and the impingement of the headbox jet is preferably inclined towards the outer wire in order not to deteriorate the ingoing moist web. The headbox jet is delivered to said twin-wire nip at such a high speed to cause a yielding deflection of the outer 13 of said two tensioned wires as disclosed in U.S. Pat. No. 3,056,719, the content of which is included as a reference in the present application. The tension of the outer wire 13 is maintained substantially constant during the deflection by guiding said wire 13 on one or more rotating supports 30*a* (only one shown in FIG. 1) at least one of which is resiliently or displaceably mounted to compensate for said deflection. The forming roll 14 may have a solid or open surface, supported with vacuum or not. In order to reach a sufficient dewatering capacity and still to limit the dewatering pressure and thereby the jet deceleration in the twin-wire nip, the forming roll radius is at least 600 mm, preferably at least 200 mm. For a sufficient dewatering capacity, the roll wrapping angle of the outer wire 13 preferably larger than 100 degrees. For higher capacity still, two or more forming rolls may be used as exemplified in the following embodiments.

The speed of said fibre suspension jet delivered to said twin-wire nip is at least 300 m/min in order to create a sufficient high speed and kinetic energy of the fibre suspension jet to cause the yielding deflection of the outer wire 13. In some cases speeds of at least 500 m/min or at least 800 m/min are preferred.

The thickness of the fibre suspension jet delivered to said twin-wire nip is preferably restricted to 15–20 mm in order to limit the outflow of fibre suspension at the edges of the machine. This together with a low headbox consistency, preferably below 0.5% for typical furnishes, in order to reach the required sheet properties means that the ply grammage of a top ply which according th the invention is formed onto a base ply is limited to 90 g/m$^2$, preferably to 70 g/m$^2$.

The wire tension of the outer as well as the inner wire is at least 4 kN/m, and the wire tension of at last the outer wire is preferably at least 6 and most preferably at least 8 kN/m in order to obtain sufficient stability, especially at high speeds.

According to the invention, the forming phase is completed during roll dewatering whether occurring on one or more forming rolls. Thereafter the fibre network structure is essentially fixed so that any significant rearrangement of the fibres does not occur as the web passe over further dewatering elements. Further consolidation of the web may then be accomplished according to well-known methods such as couch rolls, suction boxes or the like before the web enters the press section or another forming unit.

The present invention gives the following particular advantages:

- A substantially constant dewatering pressure can be obtained as the fibre suspension jet deflects the tensioned outer wire with dewatering taking place over the periphery of the forming roll.
- The dewatering capacity per unit drainage area of a roll forming unit of a type here employed is high which enables low forming consistencies (0.5% by weight and lower). A high dewatering capacity is especially important in the multi-ply forming method here presented, in which a top ply is formed onto a base ply and dewatering takes place only through the outer wire.
- An impingement of the fibre suspension jet exiting from the top ply headbox into a rwin-wire roll nip which means a general insensitivity to jet impingement conditions.
- A closed forming zone which is a prerequisite for small grammage variations at machine speeds above 1000 m/min.
- Machine speeds higher than 1000 m/min can be operated in a compact forming section with good runability, including high wire retention, according to the well known performance of roll formers.
- A good ply-bond, achieved because the top ply comes in contact with the base ply while being in the form of a fibre suspension.
- A broad range for the degree of fibre orientation, similar to that of fourdrinier machines, is possible since orientation effects during dewatering can be essentially avoided.
- Favourable mechanical properties of the individual plies can be obtained because a low forming consistency is possible with two or more forming units and because detrimental shear can be avoided during the roll dewatering.
- A good purity and formation of the web ply can be obtained, dewatering a low consistency fibre suspension through a web-free wire.

In order to realize the potential for mechanical properties in general and the Z-direction strength in particular, the shear between the fibre suspension and the wires during roll dewatering should be minimal. Therefore, the required degree of fibre orientation should preferably be generated already in the headbox rather than by means of a speed difference between the fibre suspension and the wires during dewatering. The speed difference between the fibre suspension and the wires during the dewatering can then be restricted to maximum of ±40 m/min relatively the point of minimum shear.

The degree of fibre orientation in the jet exiting from a hydraulic headbox is governed by the relative influence of turbulence and elongational strain. Turbulence is generated in the tube bank and has a randomizing effect, whereas elongational strain is imposed in the converging nozzle and has an orientating effect. For a demonstration of the influence of headbox variables on the fibre orientation degree reference is made to papers by Nordström and Norman (*Nord. Pulp Pap.* Res. 9(1): 53 (1994); 10(1): 33 (1995); *J. Pulp Pap. Sci.* 21(7): I223 (1995)). As an example, it has been demonstrated that with a rube bank design involving a high open nozzle feed area and a high nozzle contraction ratio, a fibre orientation degree corresponding to a tensile stiffness MD/CD-ratio above four can be reached at the point of minimum shear during roll dewatering.

Figure 2:
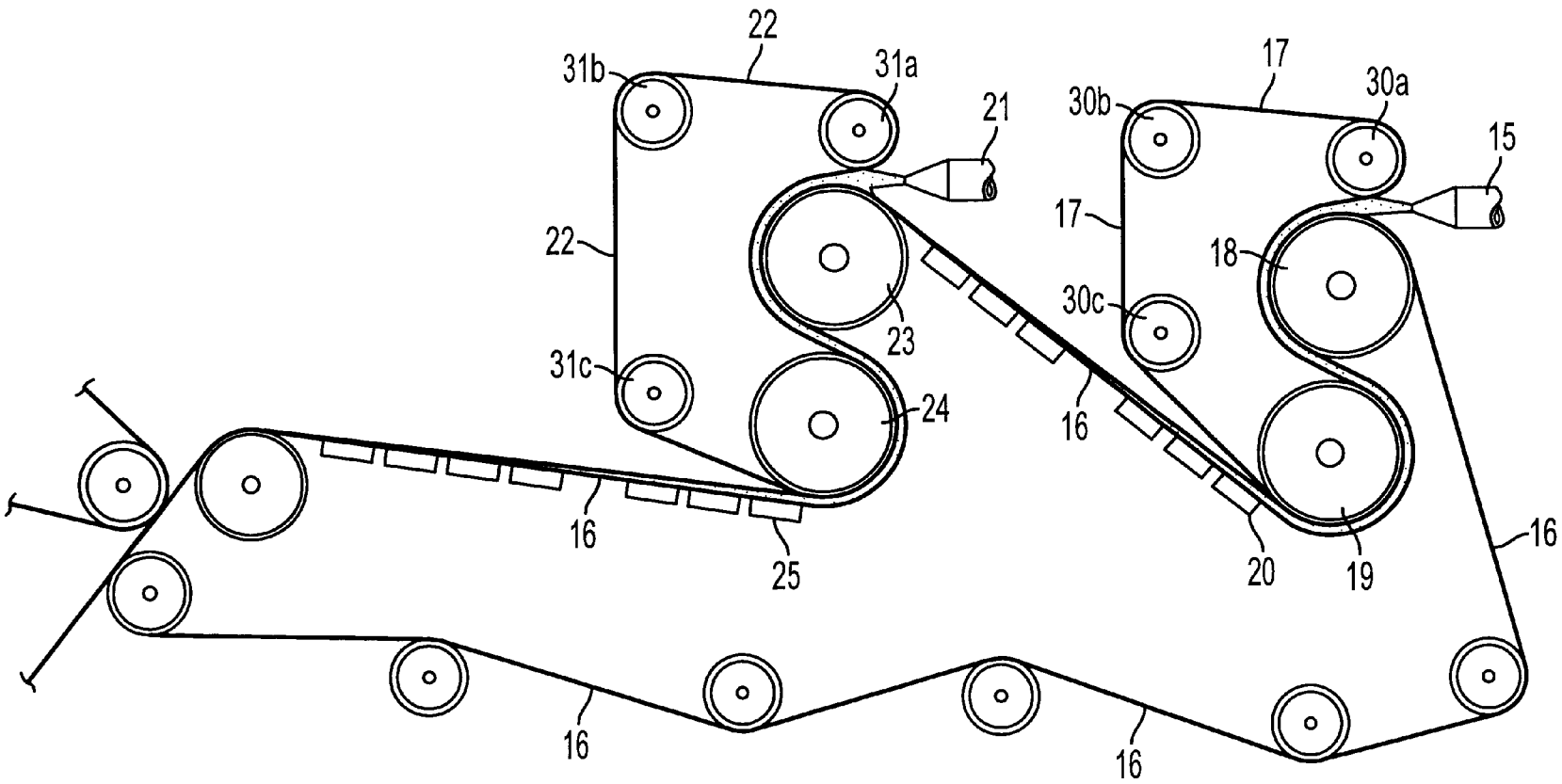
FIGS. 2 and 3 show two examples of forming sections for a two-ply web and a three-ply web respectively, both of which employ roll forming for the primary web ply and the method according to the invention for forming the other web plies.

FIG. 2 schematically shows a forming section employing roll forming for the primary web ply and the method according to the invention for the secondary web ply. The figure shows a design for a rwo-ply web, but it is understood that the design principles can be applied for a product comprising more plies. The primary ply is formed in a first twin-wire unit comprising a primary headbox 15 which delivers a fibre suspension jet into a nip created by a first endless, tensioned forming wire 16 and a second endless, tensioned forming wire 17. Both forming wires 16, 17 travel on rotating rolls 18,19 in a S-wrap. The forming phase may then end either on roll 18 or on the vacuum supplied roll 19 on which further dewatering thereafter occurs.

The second wire 17 is then separated from the web over a suction box 20, which secures the web to the first wire 16, which transfers the web to a second twin-wire unit. Here a secondary web ply is formed on the moist primary web ply, which preferably has a dryness of 7–15% by weight. This secondary unit comprises a secondary headbox 21 which delivers a fibre suspension jet into a twin wire nip created by the first wire 16 and a third endless, tensioned wire 22. The fibre suspension jet is delivered to said twin-wire nip at such a high speed to cause a yielding deflection of the outer 22 of said two tensioned wires as disclosed above with respect to FIG 1. The outer wire 22 is guided on rotating supports 31*a–c* at least one of which is resiliently or displaceably mounted to compensate for said deflection. Both wires 16, 22 travel an rotating rolls 23 and 24 in a S-wrap where the secondary web ply is formed onto the primary web ply. The forming phase may then end either on roll 23 or on the vacuum supplied roll 24 on which further dewatering thereafter occurs.

The third wire 22 is in the same way as in the first forming unit separated from the web over a suction box 25, which secures the two-ply web to the first wire 16, which transfers the sheet to the press section (not shown).

In order to minimize any detrimental effect on the sheet properties due to velocity differences between the two wires running in S-wrap, a large diameter is recommended for both rolls, preferably in the range 1200–1600 mm.

The configuration shown in FIG. 2 gives a particular advantage with regard to the tension of the outer wires, the second and third wires respectively 17 and 22, on the forming rolls determining the dewatering pressure during roll dewatering. Since the wire is in direct contact only with rotating machine elements giving a minimum of wire wear, the wire tension and thus the dewatering pressure can be kept at a higher level than if the wire runs over stationary elements.

Figure 3:
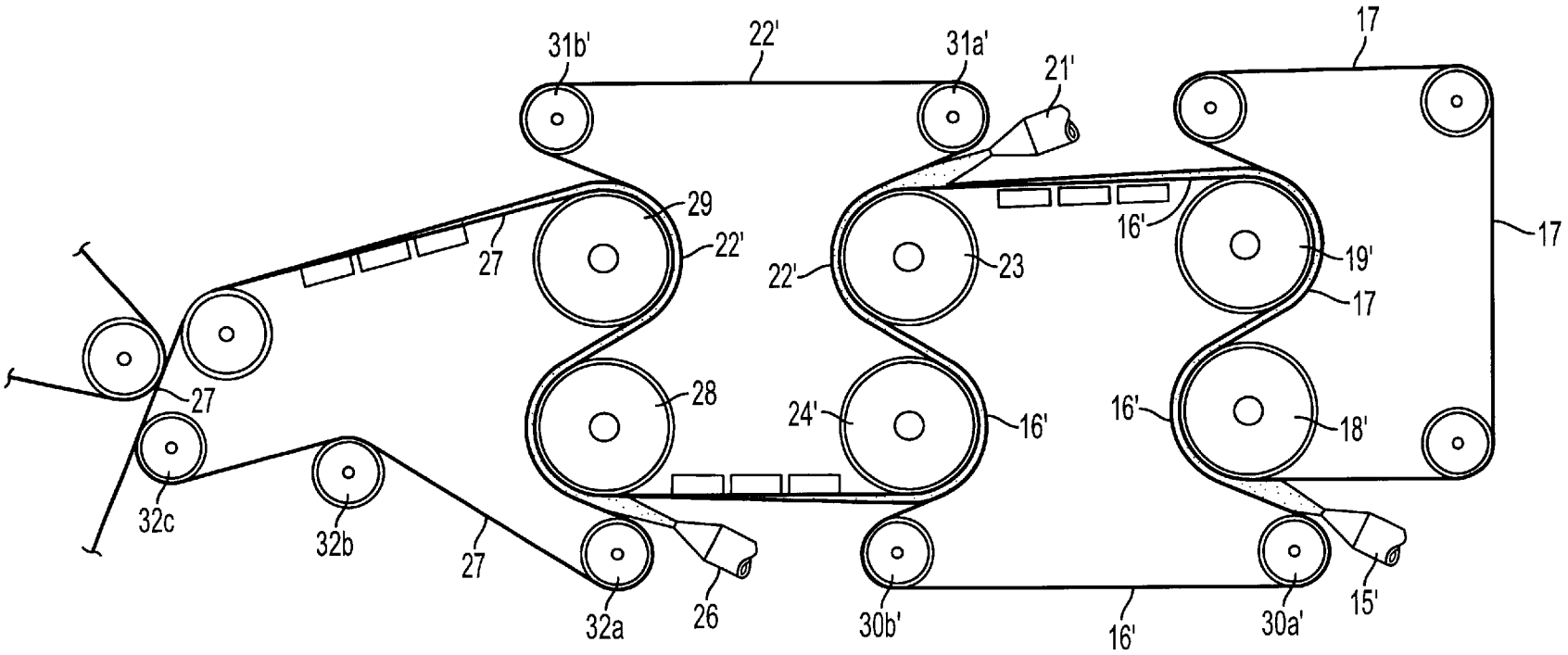

FIG. 3 shows another design employing roll forming for the primary web ply and the method according to the invention for the secondary and third web plies. The figure shows a configuration for a three-ply web but even this configuration can of course be applied to the forming of a web comprising any number of plies. A third ply is formed onto the secondary web ply by a third twin-wire unit comprising a third head box 26 and a twin-wire nip created by the third tensioned wire 22 and a fourth tensioned wire 27. The fibre suspension jet is delivered to said twin-wire nip at such a high speed to cause a yielding deflection of the outer 27 of said two tensioned wires as disclosed above. The outer wire 27 is guided on rotating supports 32*a–c* at least one of which is resiliently or displaceably mounted to compensate for said deflection. Both forming wires travel on rotating rolls 28,29 in a S-wrap. The forming phase may then end either on roll 28 or on the vacuum supplied roll 29 on which further dewatering thereafter occurs.

In contrast to the forming section shown in FIG. 2 this forming section comprises a sequence of tensioned, endless forming wires, each of which transfers the web from one forming unit to the next or to the press section. An advantage with this arrangement is the compact design. As clear from the figure, this design involves web transport on the underside of a single wire in some sections. This is however possible provided the web secured to the conveying wire by means of vacuum on the couch roll.

The invention is of course not limited to the embodiments shown and described above, but several modifications thereof are possible within the scope of the claims. The invention also contemplates that any of the headboxes used may be a multi-layer headbox.

What is claimed is:

1. A method of forming a multi-ply web of paper or board, comprising the steps of:

carrying a moist base ply on one of two tensioned members of a twin wire nip;

delivering a fibre suspension jet by means of a secondary headbox into the twin-wire roll nip to create a top ply on the base ply; and forming the top ply by roll forming a roll forming unit;

the delivering step includes delivering the fibre suspension jet to the twin-wire nip at such a high speed to cause a yielding deflection of an outer one of the two tensioned wires while maintaining a substantially constant tension of the outer wire during the deflection by guiding the outer wire on rotating supports, at least one of which supports is resiliently or displaceably mounted to compensate for the deflection;

wherein a speed at which the fibre suspension is delivered to the twin-wire nip is at least 300 m/min and the tension of the outer and inner wires is at least 4 kN/m.

2. A method as claimed in claim 1, wherein the speed at which the fibre suspension jet is delivered to said twin-wire nip is at least 500 m/min.

3. A method as claimed in claim 1, wherein a required degree of fibre orientation in the top ply is generated in the secondary headbox.

4. A method as claimed in claim 1, wherein a speed difference between the fibre suspension and the wires during the dewatering is restricted to a maximum of ±40 m/min relatively the point of minimum shear.

5. A method as claimed in claim 1, wherein the wire tension of at least said outer wire is at least 6 kN/m.

6. A method as claimed in claim 1, wherein a forming roll constituting a part of said twin-wire roll nip is used for performing said roll forming, said forming roll having a radius of at least 0.6 m.

7. A method for forming a multi-ply web as claimed in claim 1, wherein the roll forming of the kind claimed in claim 1 is performed for forming all plies including the primary ply.

8. A multi-ply paper or board product, wherein said product is formed with the method as claimed in claim 1.

9. A method as claimed in claim 2, wherein the speed at which the fibre suspension jet is delivered to said twin-nip wire is at least 800 m/min.

10. A method as claimed in claim 5, wherein the wire tension of at least said outer wire is at least 8 kN/m.

11. A method as claimed in claim 6, wherein the forming roll has a radius of at least 0.8 m.

12. A forming apparatus for forming a multi-ply web of paper or board, comprising:

two tensioned wires forming a twin-wire roll nip;

a secondary headbox arranged to deliver a fibre suspension jet to create a top ply onto a moist base ply on one of the two wires; and a roll forming unit for forming the top ply, the roll forming unit includes at least one forming roll and further includes rotating supports for the wires, the roll forming unit is constructed so as to enable a yielding deflection of an outer of the two tensioned wires where the suspension jet is delivered to the roll nip and such that a substantially constant tension is maintained in the outer wire during the deflection by guiding the outer wire on the rotating supports, and at least one of the rotating supports is resiliently or displaceably mounted to compensate for the deflection.

13. A forming apparatus as claimed in claim 12, wherein the radius of the forming roll constituting a part of said twin-wire nip is at least 0.6 m.

14. A multi-ply paper or board product, wherein said product is formed with the apparatus as claimed in claim 12.

15. A forming apparatus as claimed in claim 13, wherein the radius of the forming roll constituting a part of said twin-wire nip is at least 0.8 m.

* * * * *

UNITED STATES PATENT AND TRADEMARK OFFICE

CERTIFICATE OF CORRECTION

PATENT NO. : 6,342,125 B1
DATED : January 29, 2002
INVENTOR(S) : Bengt Nordström It is certified that error appears in the above-identified patent and that said Letters Patent is hereby corrected as shown below:

Title page,
Item [73], please insert -- [73] Assignee: SCA Research AB, Göteborg, Sweden --.

Signed and Sealed this

Twentieth Day of August, 2002

*Attest:*

*Attesting Officer*

JAMES E. ROGAN
*Director of the United States Patent and Trademark Office*